US005365952A

United States Patent [19]

Noble et al.

[11] Patent Number: 5,365,952

[45] Date of Patent: Nov. 22, 1994

[54] HAIRCUTTING DEVICE

[75] Inventors: Edward J. Noble, Corona Del Mar; Timothy Payne, Santa Ana; Rex O. Bare, Lake Forest, all of Calif.

[73] Assignee: Edward J. Noble, Corona Del Mar, Calif.

[21] Appl. No.: 32,306

[22] Filed: Mar. 17, 1993

[51] Int. Cl.[5] ..... A45D 24/38

[52] U.S. Cl. ..... 132/144; 132/129; 132/145; 132/213.1; 132/214

[58] Field of Search ..... 132/126, 127, 128, 129, 132/134, 135, 144, 145, 148, 150, 213, 213.1, 214

[56] References Cited

U.S. PATENT DOCUMENTS

| | | | |
|---|---|---|---|
| 181,904 | 9/1876 | Bow et al. | 132/213 |
| 533,466 | 2/1895 | Howard et al. | 132/148 |
| 1,040,711 | 10/1912 | Longden | 132/214 |
| 1,132,699 | 3/1915 | Wright | 132/213 |
| 1,286,823 | 12/1918 | Stahle | 132/213.1 |
| 1,853,828 | 4/1932 | Mani | 132/214 |
| 2,325,246 | 5/1942 | Halen | 132/214 |
| 2,510,943 | 4/1950 | Arnold | 132/214 |
| 2,562,421 | 7/1951 | Hendra | 132/214 |
| 2,678,047 | 5/1954 | Garfield | 132/213 |
| 3,230,619 | 1/1966 | Felland | 132/213 |
| 5,012,830 | 5/1991 | Vaccaro et al. | 132/213.1 |

*Primary Examiner*—Gene Mancene

*Assistant Examiner*—Frank A. LaViola

*Attorney, Agent, or Firm*—Lyon & Lyon

[57] ABSTRACT

There is disclosed herein a haircutting device or aid which has a pair of movable members which can be slid through the hair and moved to lift a section of hair for cutting. The device comprises a handle which is held in the hand of the user, a lower comb section and an upper comb section. The upper comb section has connected therewith a lever which allows the upper comb section to be raised with respect to the lower comb section to lift the length of hair. Preferably the lower comb section includes a smooth "comb" base member which can slide along the scalp, and the upper comb section terminates in a comb having a plurality of teeth which likewise move through the hair of the scalp and lift the length of hair to be cut. Scissors are used in a conventional manner along the upper comb member to cut the hair extending beyond the lifted length. The lower comb section is adjustable with respect to the handle which, in turn, enables adjustment of the length of hair to be lifted for cutting. A locking mechanism locks the position of the lower comb member with respect to the handle to select and fix the desired adjustment. Removable comb members are disclosed. An alternative arrangement which provides a slidable stop member also is disclosed. The components can all be molded of plastic.

21 Claims, 11 Drawing Sheets

(Lower comb at lowest adjustment, upper comb at rest)

(Lower comb at lowest adjustment, upper comb raised)

(Lower comb at highest adjustment, upper comb at rest)

(Lower comb at highest adjustment, upper comb raised)

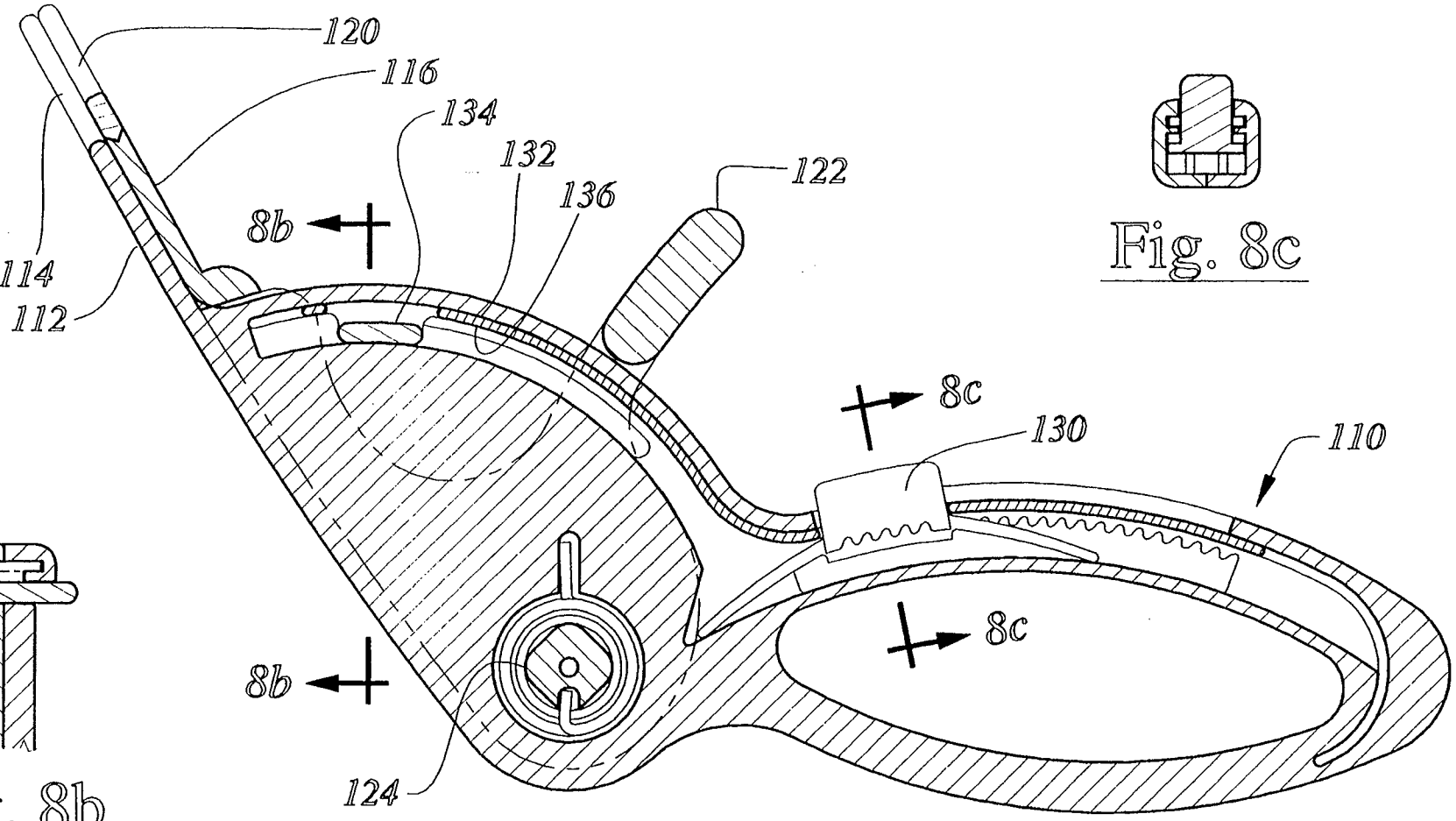
Fig. 8a
Fig. 8c
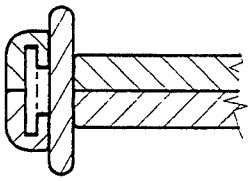
Fig. 8b

HAIRCUTTING DEVICE

This invention relates to the field of barbering or hair cutting and relates more particularly to a new and improved form of hair cutting aid or device.

BACKGROUND OF THE INVENTION

Various forms of hair cutting aids, tools and devices have been devised over the years, particularly for facilitating home or domestic use by an inexperienced person or one unskilled in the profession of barbering, so as to enable the hair to be cut at proper lengths without nicks and gouged places where the hair has been cut to a shorter length.

The patent literature dates back to at least 1876 wherein U.S. Pat. No. 181,904 was issued on a form of gauge for hair cutting. Other hair cutting or gauge devices include U.S. Pat. Nos. 1,040,711, 1,132,699, 1,286,823, 1,853,828, 2,325,246, 2,678,047, 2,562,421, 2,510,943 and 5,012,830. These devices generally comprise a scissors-like device having one or more comb structures on the ends thereof so as to enable lengths of hair to be extended for cutting. Some of these devices, including the earliest one noted above, namely U.S. Pat. No. 181,904, show mechanisms for allowing adjustment of the stroke or length of hair to be cut. One particularly interesting patent is U.S. Pat. No. 1,286,823 which shows an adjustable pivot point for allowing the stroke length of a pair of combs in a scissors-type arrangement to be adjusted. Unfortunately, the foregoing devices are relatively complex, cumbersome to use, awkward to adjust, are complex to manufacture, and the like.

SUMMARY OF THE INVENTION

It is accordingly a principal object of the present invention to provide an improved hair cutting aid or device which is relatively simple to use and easy to adjust and which can be inexpensively manufactured.

According to an exemplary embodiment of the concepts of the present invention, a device comprises a handle having a pair of scissors-like members pivotally attached thereto with one of these members forming a lower support or comb type member and the other of these members providing an upper comb. The pivot structure allows the two comb members to be relatively adjustable so as to adjust the "lift" of hair or stroke of the device for setting the length to which the hair is cut. A lever is affixed to the upper comb to allow it to be raised or moved with respect to the lower comb, and the adjustment mechanism is designed to provide an adjustable stop for the lever so as to set a limit for the "lift." This enables the lift to be set in a very simple and easy manner by depressing a lower comb hub as will be described in more detail subsequently. Preferably, the lower comb member actually comprises a relatively smooth rounded simple base member which slides along and bears against the head in the use of the device, whereas the upper comb comprises a comb support and comb having a plurality of teeth which can be relatively easily guided through the hair and then lift the hair to lift the same for cutting. Alternative arrangements also are contemplated.

Thus, further objects and features of the present invention comprise a hair cutting aid having a pair of pivotally mounted comb members which can be moved to lift a length of hair, and wherein the degree of lift can be simply and readily adjusted.

Another object is to provide a hair cutting device wherein comb members can be readily removed from a comb holder or holders for cleaning, or changing to finer or coarser-toothed combs.

Another object of the present invention is to provide a haircutting device wherein the relationship between a handle, lever and comb is arranged to be more ergonomic for lifting different lengths of hair for cutting.

A further object of the present invention is to provide an improved form of removable comb for a haircutting device.

A further object of the present invention is to provide an alternative haircutting device which can enable lift adjustment through the use of a thumb slide mechanism.

These and other objects and advantages of the present invention will become better understood through a consideration of the following description, taken in conjunction with the drawings in which:

BRIEF DESCRIPTION OF THE DRAWINGS

FIGS. 7 through 9 illustrate an alternative embodiment providing for thumb adjustment of the lift, and wherein FIG. 7 is a simplified perspective view, FIG. 8*a* is a side view thereof with FIGS. 8*b* and 8*c* being cross-sectional views along respective lines 8*b*—8*b* and 8*c*—8*c*, and FIGS. 9 is a view similar to FIG. 8*a*, but with an upper comb in the fully extended or full "lift" position.

DETAILED DESCRIPTION

Figure 1:
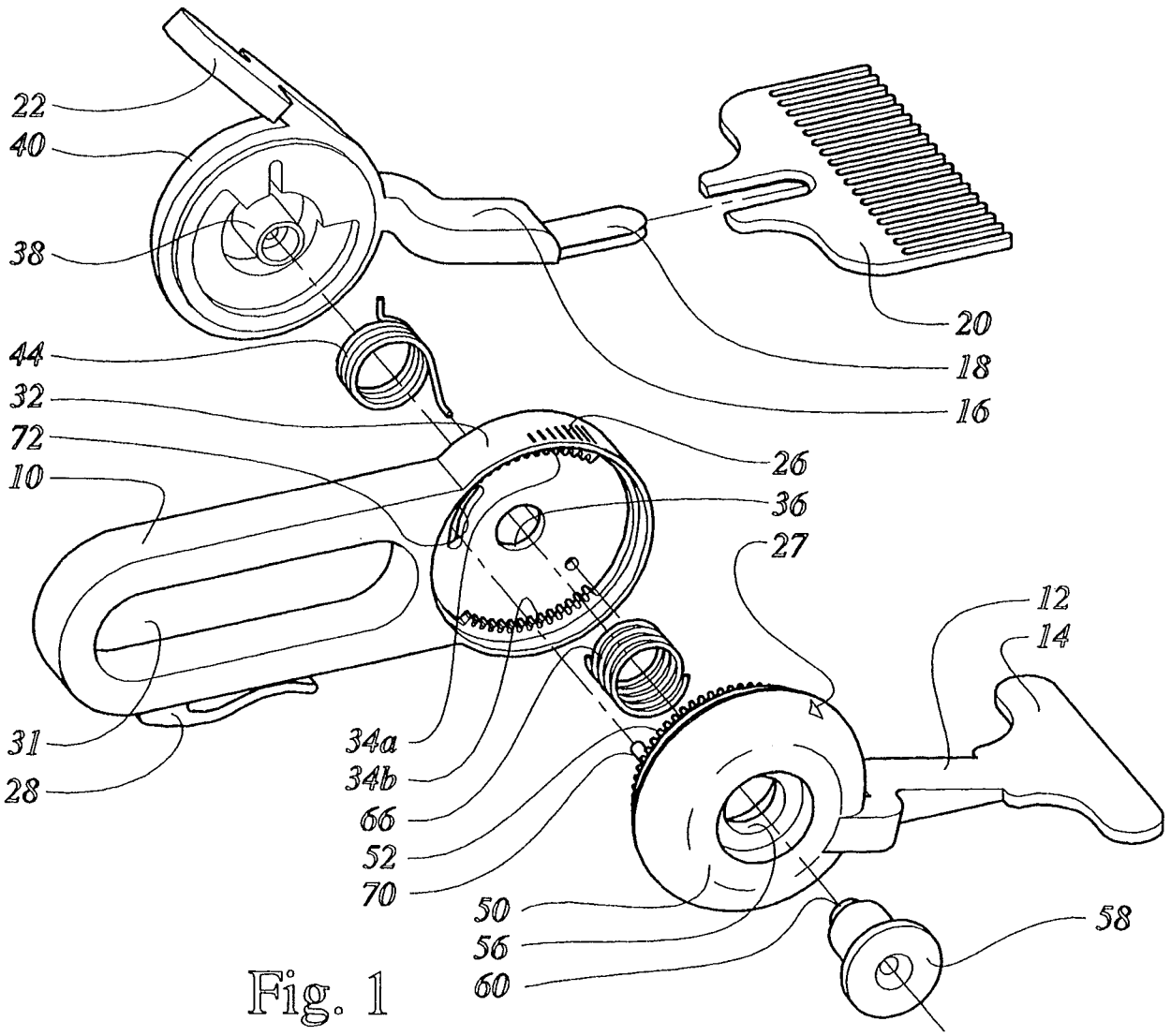
FIG. 1 shows a simplified exploded perspective view of a preferred embodiment of the present hair cutting device.
Figure 2A:
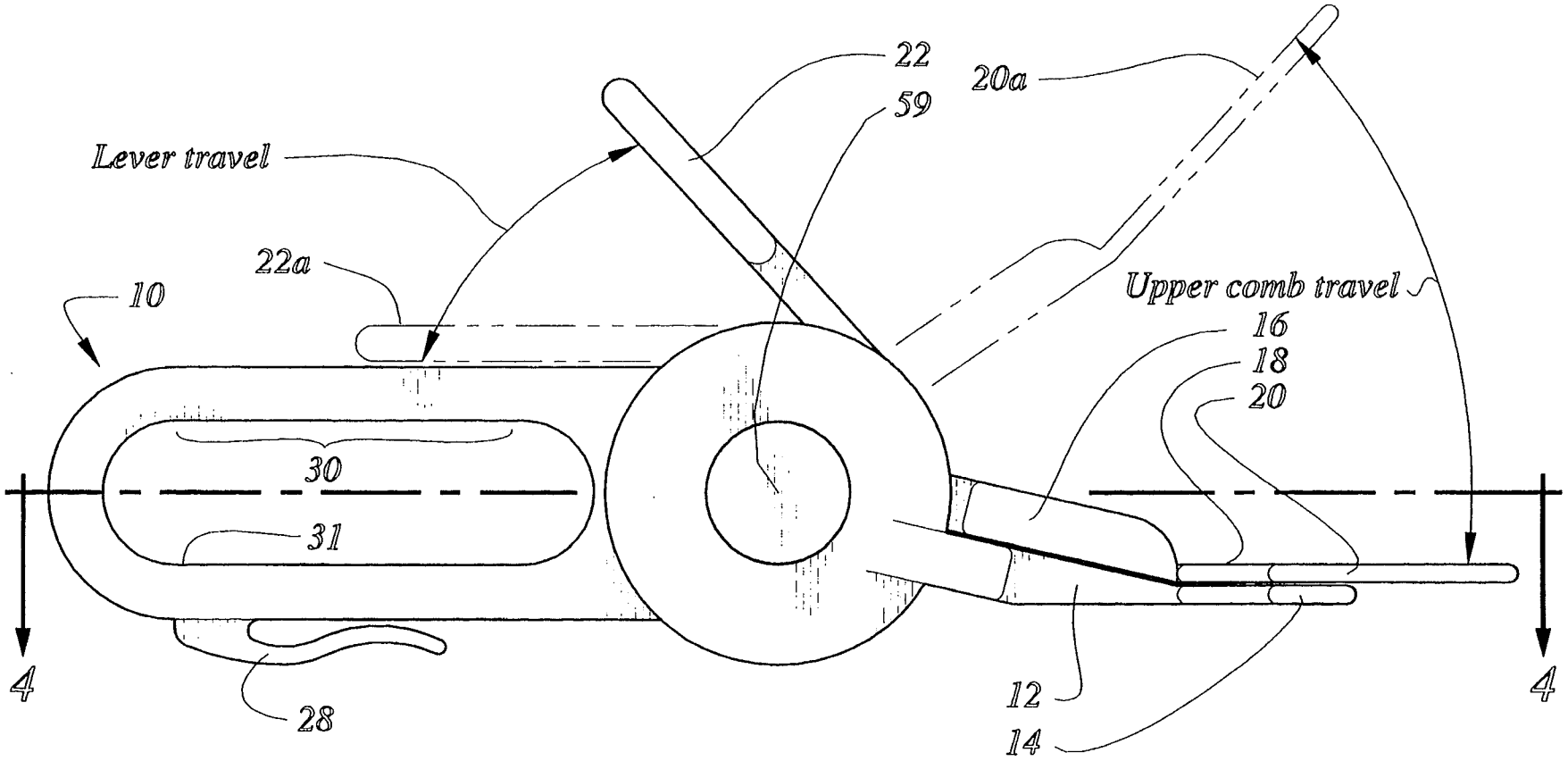
FIGS. 2*a* and 2*b* respectively illustrate exterior right side and top views of the device of FIG. 1.
Figure 2B:
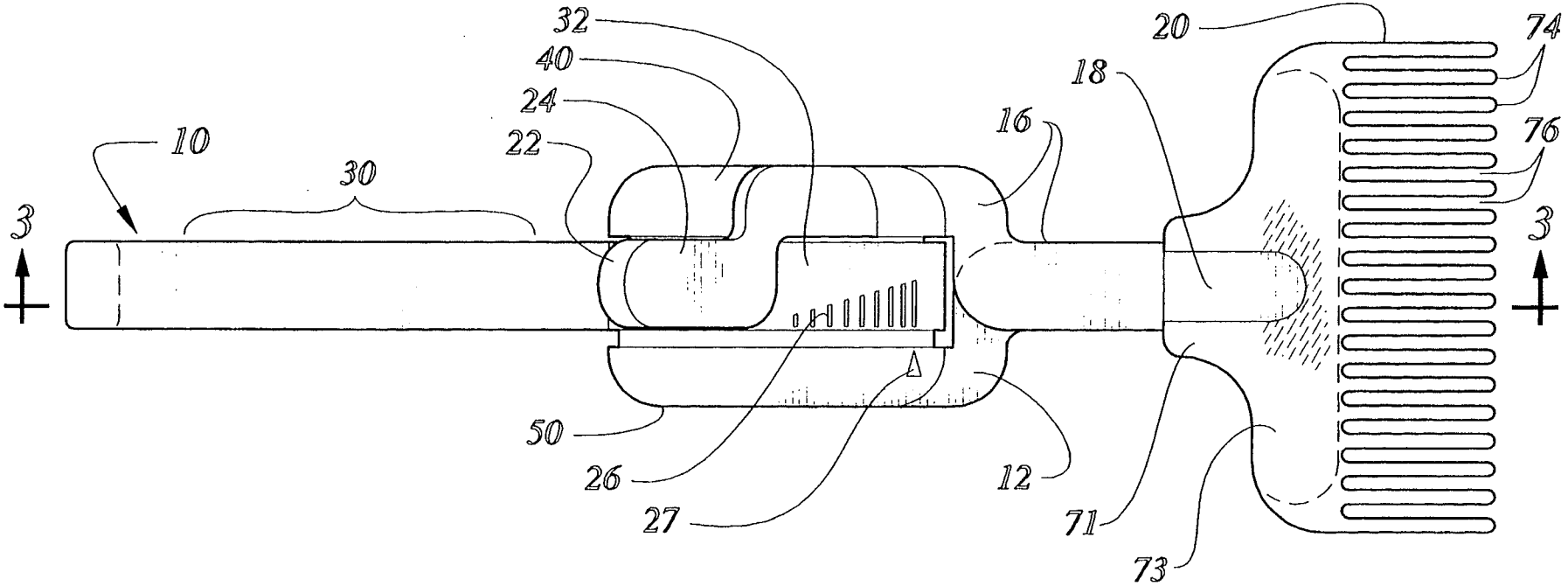

Turning now to the drawings and principally first to FIGS. 1 and 2, a haircutting aid or device according to the present invention comprises a handle 10 forming a hand grip with an elongated finger slot 31, a lower comb arm 12 holding a lower support member 14 generally referred to herein as a comb, an upper comb arm 16 with a comb holder 18 and a removable upper comb 20, and a lever 22 which forms an integral part of the upper comb arm. The support member 14 bears against the scalp when the present device is in use as will be described in more detail later. The lever extends upwardly as seen in FIGS. 2*a*–2*b* and jogs back over at 24 above and aligned with the body of the handle 10. The lever 22 and offset 24 is arranged so that the offset portion 24 of the lever 22 preferably is approximately aligned with the handle 10 to provide a more comfortable arrangement for depression of the lever 22 by the thumb of the operator while the hand grips the hand grip section 30. The body of the handle 10 includes an adjustment scale 26 and indicator 27 to enable the user to readily select and see what lift adjustment has been selected as will be described subsequently. The handle 10 preferably has an integrally formed belt clip 28 as seen in FIGS. 2*a*. All of the components of the present device preferably are molded from plastic, such as polystyrene, polycarbonate, nylon or ABS.

The detailed operation of the present device will be described later, but it can be seen from FIG. 2*a* that by depression (counterclockwise rotation) of the lever 22 to the dotted line position 22*a* causes the upper comb arm 16, upper comb holder 18 and upper comb 20 to rise to the dashed line position 20*a* shown in FIG. 2*a*. This operation is further illustrated in FIGS. 5*a*–5*b* for a full or maximum "lift" and in FIGS. 5*c*–5*d* for a minimum lift. After the hair is lifted by upper comb 20 it is cut in a conventional manner with scissors used along the upper face of the upper comb 20.

Figure 3:
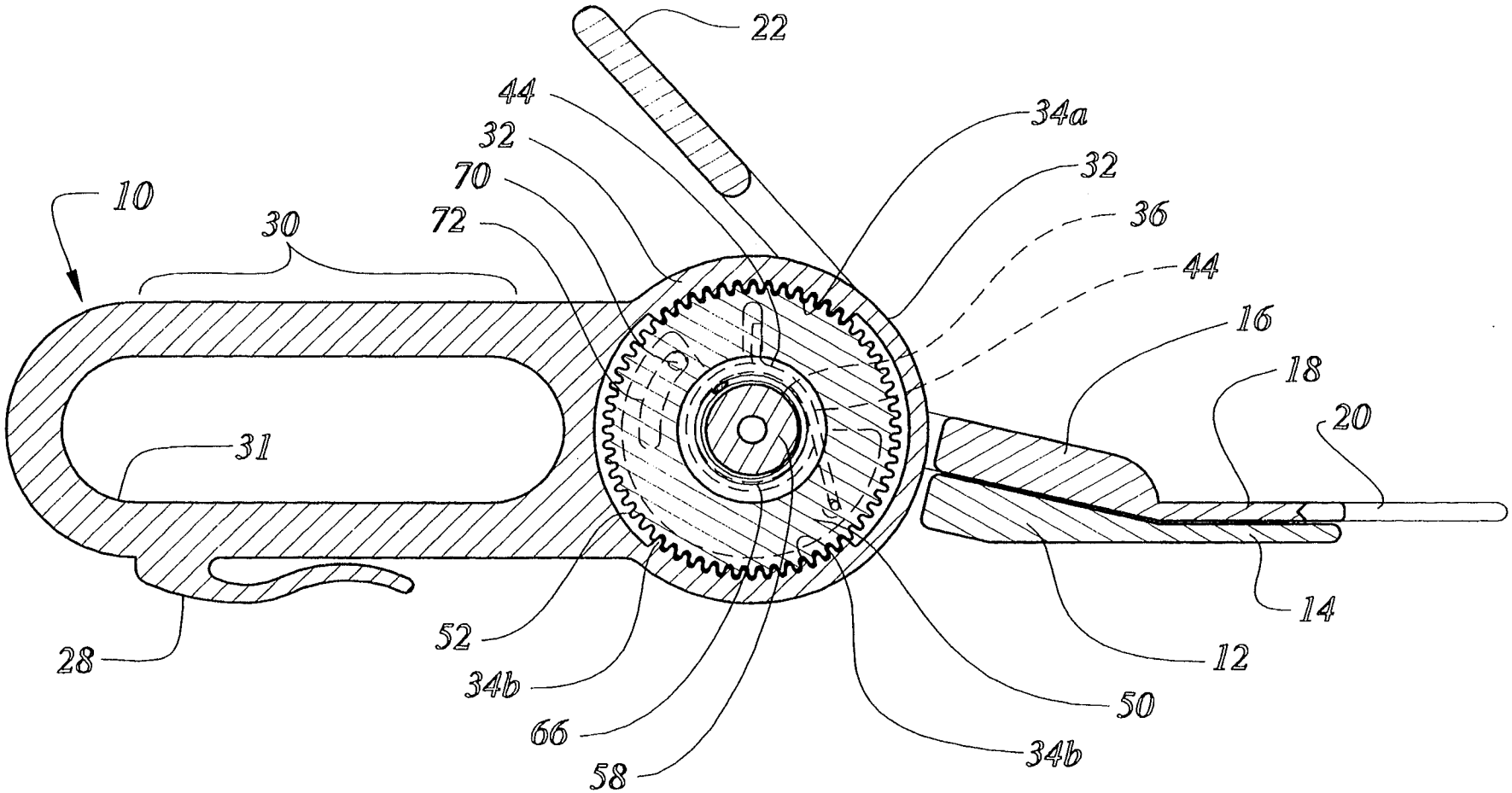
FIG. 3 is a cross-sectional view of the device taken along a line 3—3 of FIG. 2*b;*
Figure 4A:
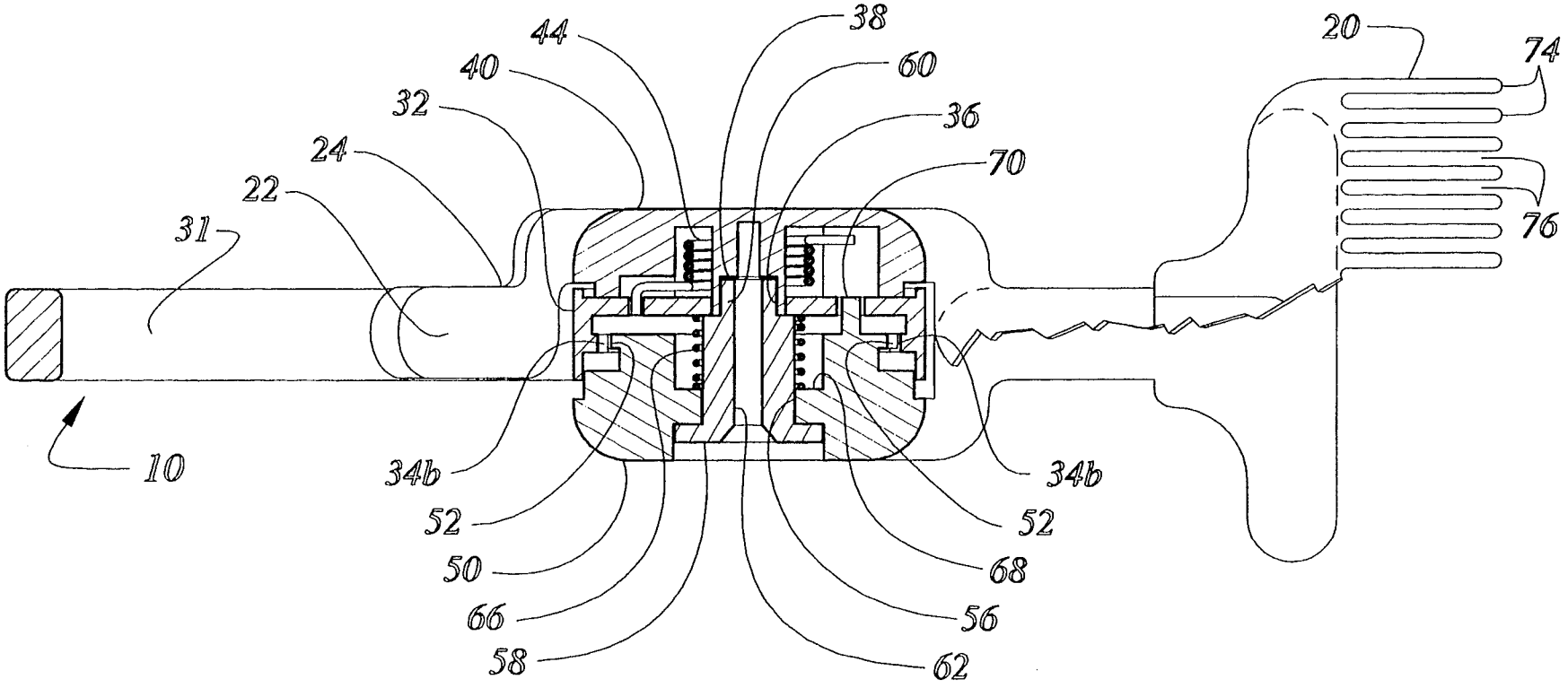
FIGS. 4*a* and 4*b* are cross-sectional views taken along a line 4—4 of FIG. 2*a*, with FIG. 4*a* illustrating the device in an operating position and FIG. 4*b* illustrating the device in an adjusting position.
Figure 4B:
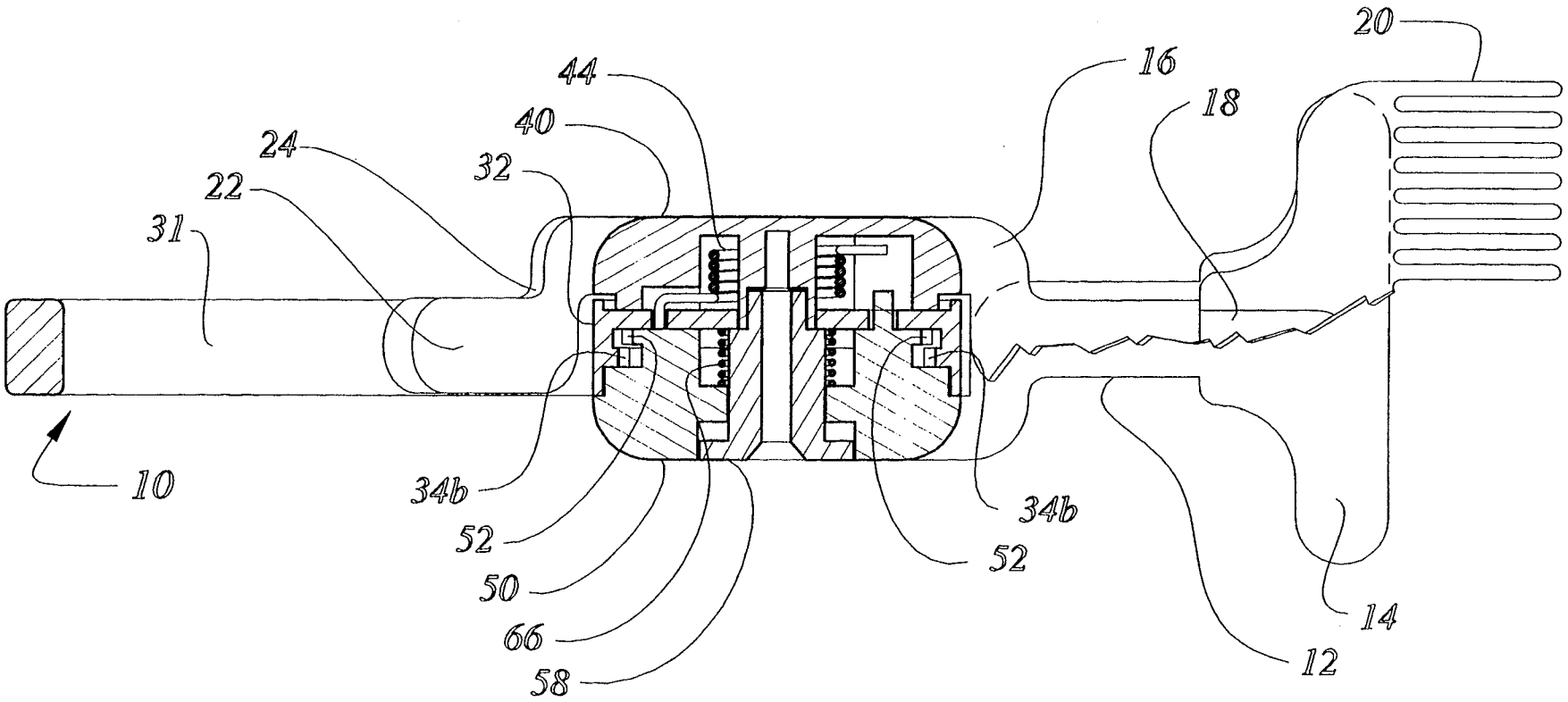

Turning now to further details of the construction of the present device, and particularly to the cross-sectional views of FIGS. 2*a*, 3 and 4, the handle 10 includes a hand grip section 30 having a slot 31 for the fingers of the hand of the person using the device, and the hand grip section 30 extends to an integral handle hub 32 which is substantially cylindrical and includes upper and lower sets of teeth 34*a* and 34*b*. These teeth, as will be further described subsequently, mesh with mating teeth 52 of a lower comb hub 50 to form a locking mechanism and can be disengaged to allow the orientation of the lower comb arm 12 and comb 14 to be angularly adjusted with regard to the handle 10 and, thus, adjusted with regard to the upper comb arm/upper comb to adjust the lift. The handle hub 32 includes a circular opening 36 (FIG. 4*a*) for receiving a boss section 38 of an upper comb hub 40.

The upper comb hub 40, the upper comb arm 16 and the lever 22 are molded in one integral piece, and the hub boss 38 of the upper comb hub 40 allows the hub 40, along with the arm 16 and lever 22, to rotate with respect to the handle 10 which, in turn, allows the upper comb 20 to be raised (note the dashed line position 20*a* in FIG. 2*a* as mentioned earlier) to lift the hair for cutting. A torsion spring 44 is connected between the upper comb hub 40 and the handle hub 32 to normally bias the hub 40, arm 16 and lever 22 assembly to the rest or closed position as shown in full lines FIGS. 2*a* and 3 (as well as in FIGS. 5*a* and 5*c*). The torsion spring 44 has one end engaged in an aperture in the handle hub 32 and the other end engaged with an inner surface of the upper comb hub 40. Movement of the upper comb lever 22 in a counterclockwise direction (as viewed in FIG. 2*a* or FIG. 3) further tensions the torsion spring 44, and the spring will return the lever 22 to its raised position (full line in FIG. 2*a* and FIG. 3) when the lever 22 is released.

The lower comb arm 12 has an integrally molded lower comb hub 50, and this hub 50 has a plurality of peripheral teeth 52 which engage with teeth 34*a* and 34*b* of the handle hub 32 to allow adjustment of the lower comb arm with regard to the handle 10 and to lock this arm 12 and handle 10 in a preselected angular relationship which, in turn, determines the extent of the lift when the upper comb arm 16 is raised by depressing the lever 22 toward the hand grip section 30 of the handle 10. The lower comb hub 50 has a central opening 56 (FIG. 4*a*–4*b*) for receiving a pivot pin 58 which has a boss 60 which extends through the handle hub 32 and into the boss 38 of the upper comb hub 40 and may be secured to the upper comb hub 40 by a screw (not shown) which fits within a central axial screw opening 62. This arrangement secures together the pivot pin 58 and upper comb hub 40 thereby retaining the lower comb hub while allowing relative rotation of the lower comb arm 12 with regard to the hand grip 10 for adjustment, as well as relative rotation between the upper comb arm 16 and lever 22 with respect to the handle 10 for raising the upper comb 20 with respect to the lower comb 14. A cover 59 (FIG. 2*a*) may be secured over the pin 58.

The lower comb arm 12 is adjusted with respect to the handle 10 by depressing the lower comb hub 50 axially (upwardly as viewed in FIG. 4*b*, or into the paper as viewed in FIG. 2*a*) with respect to the handle hub 32 so as to disengage the lower comb teeth 52 from the handle teeth 34*a*–*b*. A compression spring 66 is disposed between the handle hub 32 and an inner wall 68 of the lower comb hub 50 to normally bias the lower comb hub 50 outwardly (downwardly to the position shown in FIG. 4*a*) to normally maintain the lower comb teeth 52 in engagement with the handle teeth 34*a*–*b*. Thus, when the lower comb hub 50 is depressed to the position shown in FIG. 4*b*, the teeth 52 are disengaged from the teeth 34*a*–*b* thereby allowing the lower comb hub 50 to be rotated with respect to the handle 10, with the adjustment position indicated by the adjustment scale 26 and indicator 27 to set the degree of lift. Then, the lower comb hub 50 is allowed to return under the force of the compression spring 66 to the operating position shown in FIG. 4*a* to thereby lock together certain of the lower comb teeth 52 with handle teeth 34*a*–*b*. The size and number of teeth 34*a*–*b* and 52 are such that degrees of lift can be adjusted in small increments. The lower comb hub 50 includes a limit pin 70 which rides in an arcuate slot 72 in the handle hub so as to set the degree of angular travel between the lower comb arm 12 and handle 10 to thereby set the limits of the "lift." In this regard, note in particular FIGS. 5*b* and 5*d* which show the typical limits of the lift.

Figure 5A:
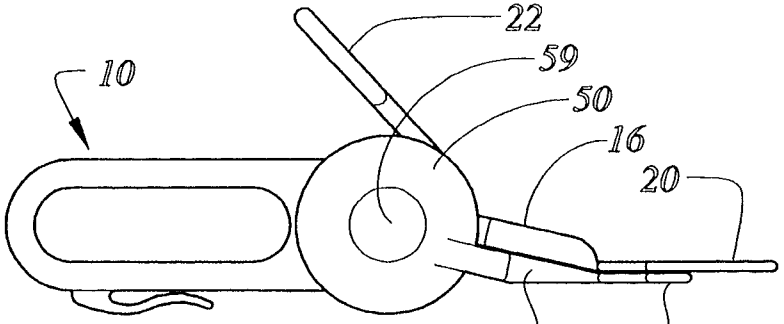
FIGS. 5*a* through 5*d* illustrate the device adjusted for the greatest lift (FIGS. 5*a*–5*b*) and the device adjusted for the smallest lift (FIGS. 5*c*–5*d*)
Figure 5B:
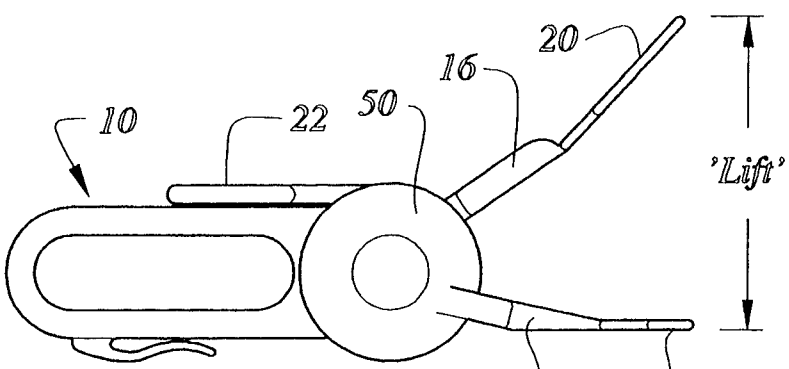
Figure 5C:
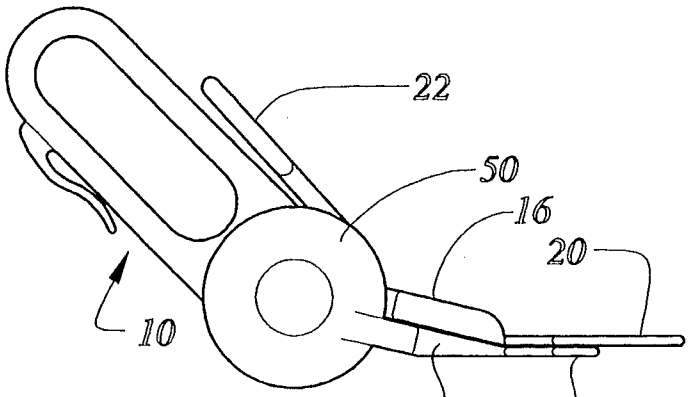
Figure 5D:
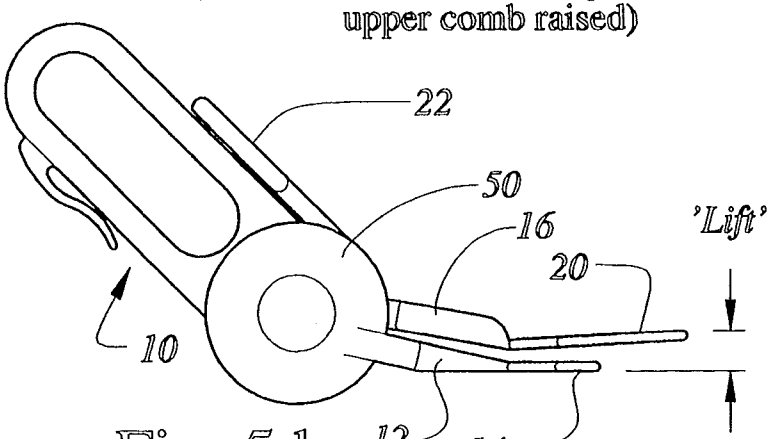

Turning now to FIGS. 5*a*–5*d*, FIGS. 5*a* and 5*b* illustrate the present haircutting device adjusted for a maximum "lift;" that is, with the lower comb arm 12 essentially adjusted to be aligned with the handle 10 as seen in FIG. 5*a*. On the other hand, FIGS. 5*c* and 5*d* illustrate the other limit of lift adjustment for a minimum hair lift, and wherein the handle 10 has been rotated to an angularly raised position as seen in FIGS. 5*c*–5*d* with respect to the lower comb arm 12 and lower comb 14 (accomplished by depression of the lower comb hub 50 as explained earlier in the discussion of FIGS. 4*a*–4*b*). The angular adjustment between the handle 10 and lower comb arm 12 and lower comb 14 additionally places the users wrist in the most comfortable position for the corresponding length of hair being cut; i.e. the device-to-handle angle is greatest when set for close-cutting (e.g. the nape of the neck) and it is least when working with longer lengths of hair typically disposed higher on the head. This helps prevent wrist strain on the part of the operator and gouging of the scalp of the person whose hair is being cut.

The upper comb 20 can be designed to be at a slight downward angle so as to remain closer to parallel with lower comb 14. Also, different types of combs and combs of different materials can be used so the hair does not slide out easily.

Turning again to the structure of the upper and lower combs, preferably the lower comb 14 is merely a simple rounded base rather than an actual comb with teeth so as to help the hair cutting device run or slide easily along the scalp. It can include some teeth, such as one at each to stabilize sliding in and along the scalp. This lower comb 14 can be removable for cleaning, although as shown in the present drawings it is integrally molded with the lower comb arm 12 and lower comb hub 50.

The upper comb 20 includes a base 71 with an elongated slot (not shown) which fits onto the upper comb holder 18 which is the outer end of the upper comb arm 16. This holder 18 fits snugly into the opening of the base 71 of the upper comb 20 to securely retain the comb 20 on the arm 16, but still allow the comb 20 to be removed for cleaning. The base 71 extends into a body portion 73 which has a plurality of teeth 74 spaced as indicated at 76. These are relatively long teeth so as to relatively easily slide into the hair to lift the hair for cutting. The teeth 74 are smooth and rounded.

Figure 6A:
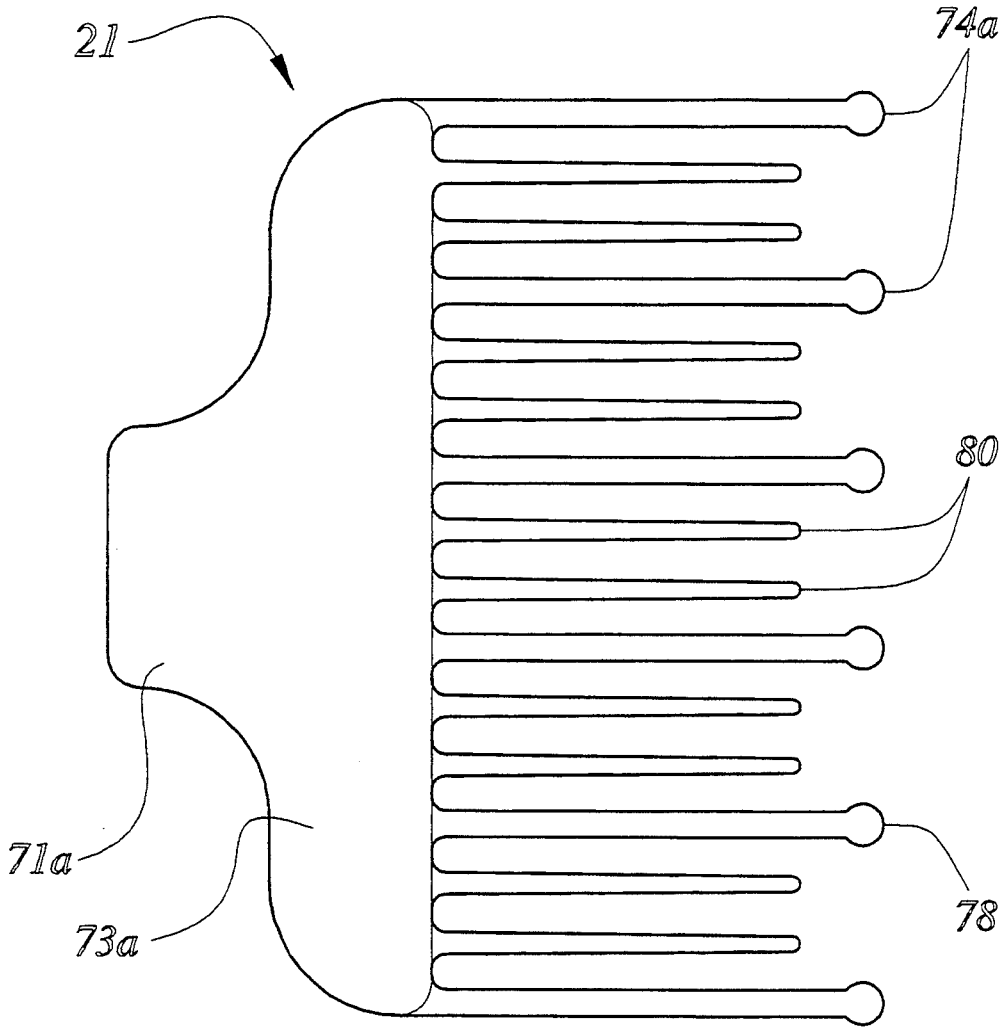
FIG. 6*a* and 6*b* illustrate an alternative form of removable top comb.
Figure 6B:
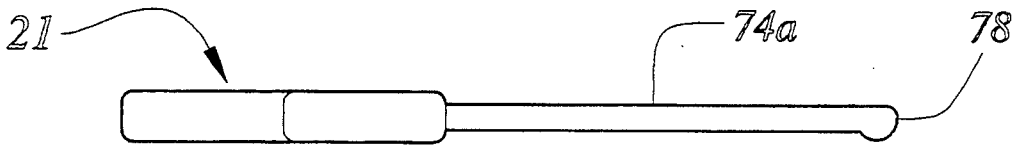

FIGS. 6*a* and 6*b* illustrate an alternative form 21*a* for the upper comb. This alternative comb 21*a* also has a base 71*a* to fit onto the upper comb holder 18 and a comb body 73*a*. However, the comb 21*a* has teeth 74*a* which are relatively large and fat and which terminate at the tip in rounded edges 78. The teeth 74*a* are relatively widely spaced, and two or three shorter and finer teeth 80 are disposed between the larger teeth 74*a*. The larger and fatter teeth 74*a* help the comb 21*a* run along the scalp without hurting the person whose hair is being cut, while the shorter and finer teeth 80 between the larger teeth 74*a* help get a firmer hold of the hair as the comb 28 lifts the hair to be cut. Narrowly spaced teeth are preferred for short or fine hair, while widely spaced teeth are needed for longer or coarse hair.

Figure 7:
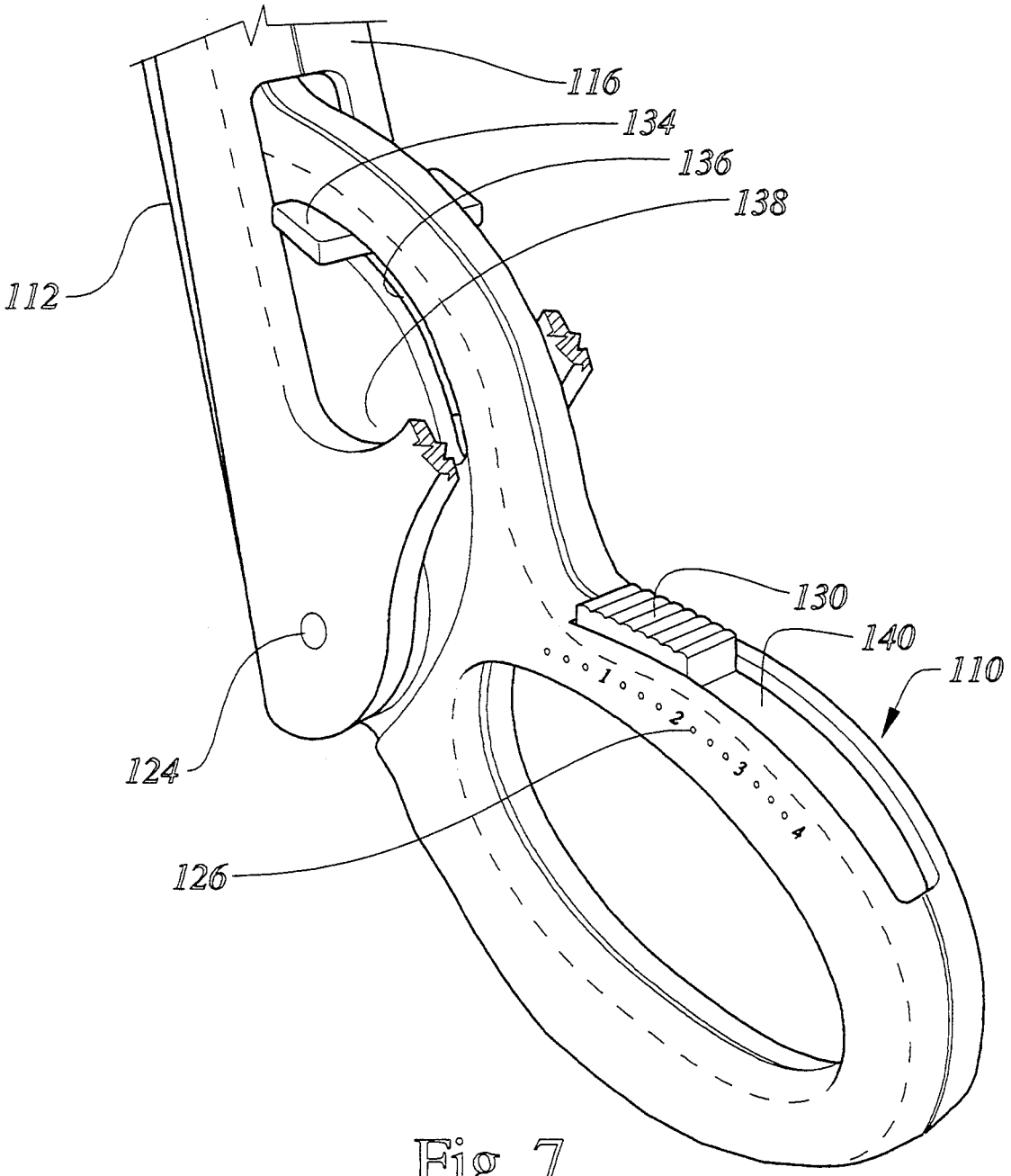
Figure 9:
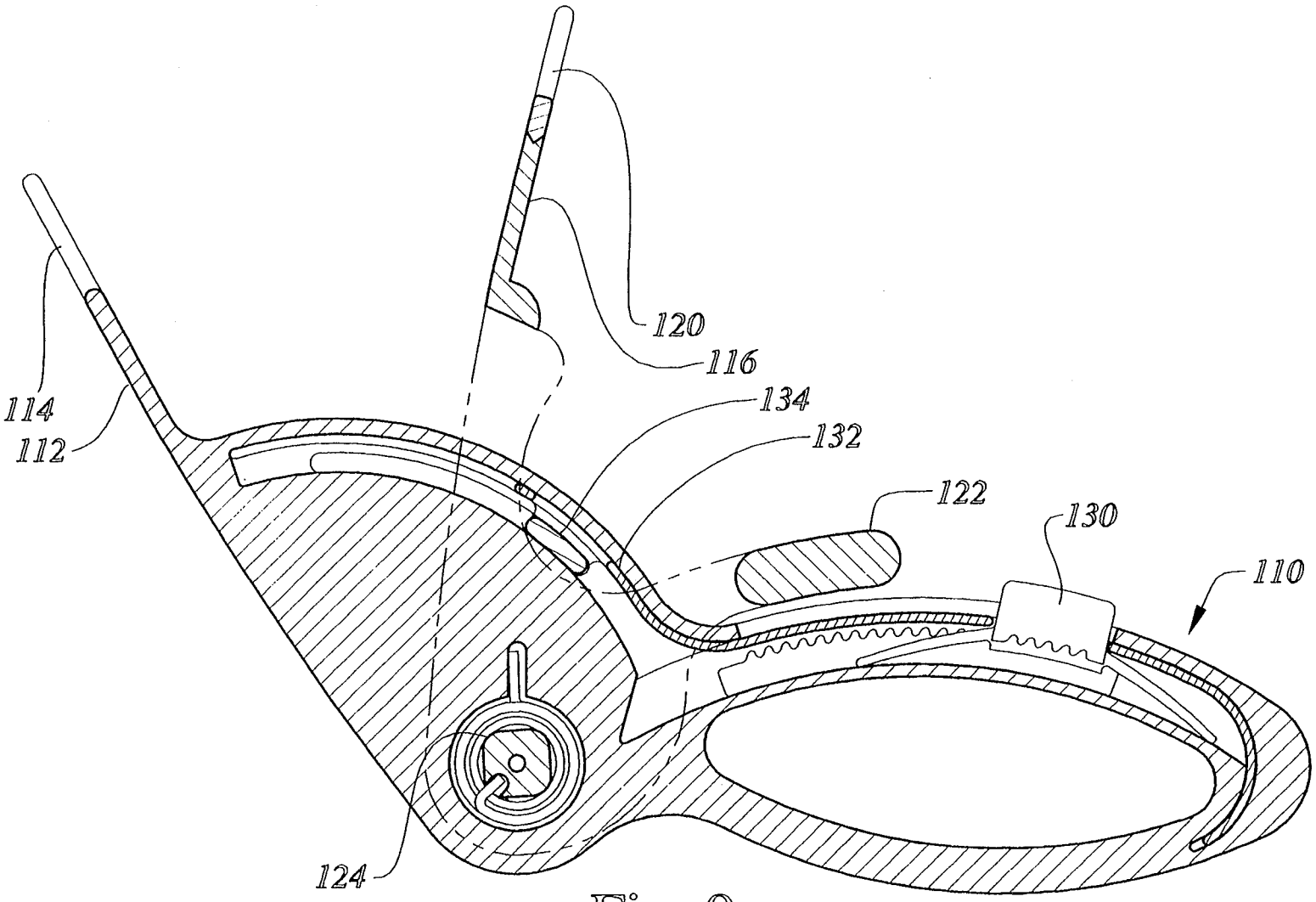

FIGS. 7 through 9 illustrate an alternative hair cutting device according to the present invention and which uses a finger slide mechanism to set the lift limit. In this embodiment, a handle 110 is integrally formed with a lower comb arm 112 and comb 114. An upper comb arm 116 with upper comb 120 is integrally formed with a lever 122, and this assembly is pivoted at 124 with respect to the handle 110—arm 112 assembly. A spring-loaded push button 130 which can lock in any position along a section of the handle 110 is connected via a flexible band 132 with a stop 134 to set the degree of lift. The stop 134 rides in an arcuate slot 136 in a body section 138 of the handle 110. The position of the stop 134 is set by depressing (pushing down as shown in FIG. 7) on the push button 130, and moving the push button 130 to a selected position along a slot 140 in the handle 110, and this sliding action changes the position of the stop 134. The position of the stop 134 limits the opening travel of the upper comb arm 116 in a manner illustrated in FIG. 9. A suitable adjustment scale 126 allows the user select the appropriate adjustment for the desired length of hair.

While embodiments of the present invention have been shown and described, various modifications may be made without departing from the scope of the present invention, and all such modifications and equivalents are intended to be covered.

What is claimed is:

1. A haircutting device for aiding in cutting selected lengths of hair comprising a handle member having a hand grip section and a hub section, said handle member having detents thereon, a first comb member including a comb arm and a comb hub, the comb hub being pivotally mounted with respect to the section of the handle member, and including detents for cooperating with the detents of the handle member to enable the first comb member to be rotated and selectively locked in a predetermined angular relationship with respect to the handle member, and a second comb member including a comb arm and a comb hub, the comb hub of the second comb member being rotatably mounted on and with respect to the handle member, the second comb member having a comb attached to the comb arm thereof, and further including a lever member for allowing the second comb member to be rotated with respect to the handle member and also with respect to the first comb member to enable a length of hair engaged by the comb to be raised for cutting.

2. A haircutting device as in claim 1 including a torsional spring member coupled between the comb hub section of the handle member and the hub of the second comb member for normally biasing the second comb member in a predetermined closed direction.

3. A haircutting device as in claim 1 wherein the comb hub of the first comb member is axially movable with respect to the hub section of the handle member to disengage the respective detents thereof and to allow the comb hub to be rotated with respect to the hub section of the handle member to allow angular adjustment thereof, and a spring member between the hub section of the handle member and the comb hub of the first comb member for selectively retaining the detents of the handle member and first comb member in locked engagement.

4. A haircutting device as in claim 1 wherein the comb of said second comb member has a base section detachable from the comb arm of the second comb member, and has a plurality of teeth for enabling a length of hair to be lifted for cutting.

5. A haircutting device as in claim 4 wherein the teeth of the second comb include a plurality of primary teeth having tips with rounded edges and including a plurality of shorter and finer teeth intermediate said primary teeth to facilitate obtaining a firm hold on the hair as the comb of the second comb member lifts hair to be cut.

6. A haircutting device as in claim 1 wherein said detents of said handle member include a movable stop member, and said detents of said first comb member includes a portion of the first comb member.

7. A haircutting device as in claim 1 wherein each of the respective handle member, first comb member and second comb member is integrally molded as one piece.

8. A haircutting device for aiding in cutting selected lengths of hair comprising a handle member having a hand grip section and a hub section, said handle member having detents thereon, a first comb member including a comb arm and a comb hub, the comb hub being pivotally mounted with respect to the hub of the handle member and including detents for cooperating with the detents of the handle member to enable the first comb member to be rotated and selectively locked in a predetermined angular relationship with respect to the handle member, a second comb member including a comb arm and a comb hub, the comb hub of the second comb member being rotatably mounted on and with respect to the handle member, the second comb member having a comb attached to the comb arm thereof, and further including a lever member for allowing the second comb member to be rotated with respect to the handle member and also with respect to the first comb member to enable a length of hair engaged by the comb to be raised for cutting, and the detents of the handle member and the detents of the first comb member comprise meshing teeth on the respective hub section and comb hub.

9. A haircutting device as in claim 8 including limiting means for limiting relative adjustment between the handle member and the first comb member.

10. A haircutting device for aiding in cutting of hair comprising a handle member having a hand grip section and a hub section, said handle member having detents thereon, a first support member including a support arm and a support hub, section the support hub being pivotally mounted with respect to the hub of the handle member, and including detents for cooperating with the detents of the handle member to enable the first support member to be selectively locked in a predetermined angular relationship with respect to the handle member, and a comb member including a comb arm and a comb hub, the comb hub of the comb member being rotatably mounted with respect to the handle member, the comb member having a comb attached to the comb arm thereof, and further including a member for allowing the comb member to be rotated with respect to the handle member and also with respect to the first support member to enable hair engaged by the comb to be raised for cutting.

11. A haircutting device for aiding in cutting of hair comprising a handle member having a hand grip section and a hub section, said handle member having detents thereon, a first support member including a support arm and a support hub, the support hub being pivotally mounted with respect to the hub section of the handle member, and including detents for cooperating with the detents of the handle member to enable the first support member to be selectively locked in a predetermined angular relationship with respect to the handle member, a comb member including a comb arm and a comb hub, the comb hub of the comb member being rotatably mounted with respect to the handle member, the comb member having a comb attached to the comb arm thereof, and further including a member for allowing the comb member to be rotated with respect to the handle member and also with respect to the first support member to enable hair engaged by the comb to be raised for cutting, the detents of the handle member and the detents of the first support member comprise meshing teeth on the respective hub section and support hub, and a spring member is coupled between the hub section of the handle member and the hub of the comb member for normally biasing the comb member toward a predetermined closed direction.

12. A haircutting device as in claim 11 wherein the hub of the first support member is axially movable with respect to the hub section of the handle member to disengage the respective detents thereof and to allow the comb hub member to be rotated with respect to the hub section of the handle member to allow angular adjustment thereof, and a spring member is disposed between the hub section of the handle member and the hub of the first support member for selectively retaining the detents thereof in locked engagement.

13. A haircutting device as in claim 12 wherein the comb of said comb member has a base section detachable from the comb arm of the comb member, and has a plurality of teeth for enabling a length of hair to be lifted for cutting.

14. A haircutting device as in claim 13 wherein the plurality of the comb include a plurality of primary teeth having tips with rounded edges and including a plurality of shorter and finer teeth intermediate said primary teeth to facilitate obtaining a firm hold on the hair as the comb of the comb member lifts hair to be cut.

15. A haircutting device as in claim 14 wherein each of the respective handle member, first support member and comb member is integrally molded as one piece.

16. A haircutting device as in claim 13 including limiting means for limiting the relative adjustment between the handle member and the first support member.

17. A haircutting device for aiding in cutting selected lengths of hair comprising a handle member having a hand grip section and a hub section, said handle member having detents thereon, a first lower comb member including a comb arm and a comb hub, the comb hub being pivotally mounted with respect to the hub section of the handle member, and including detents for cooperating with the detents of the handle member to enable the first comb member to be rotated and selectively locked in a predetermined angular relationship with respect to the handle member, the comb hub of the first lower comb member being axially movable with respect to the hub section of the handle member to disengage the respective detents thereof and to allow the comb hub to be rotated with respect to the hub section of the handle member to allow angular adjustment thereof, and a spring member between the hub section of the handle member and the comb hub of the first lower comb member for selectively retaining the detents thereof in locked engagement, and a second upper comb member including a comb arm and a comb hub, the comb hub of the second upper comb member being rotatably mounted on and with respect to the hub section of the handle member, the second upper comb member having a comb attached to the comb arm thereof, and further including a lever member for allowing the second upper comb member to be depressed by a thumb and rotated with respect to the handle member and also with respect to the first lower comb member to enable a length of hair engaged by the comb to be raised for cutting.

18. A haircutting device for aiding in cutting selected lengths of hair comprising a handle member having a hand grip section and a hub section, said handle member having detents thereon, a first lower comb member including a comb arm and a comb hub, the comb hub being pivotally mounted with respect to the hub section of the handle member, and including detents for cooperating with the detents of the handle member to enable the first comb member to be rotated and selectively locked in a predetermined angular relationship with respect to the handle member, the comb hub of the first lower comb member being axially movable with respect to the hub section of the handle member to disengage the respective detents thereof and to allow the comb hub to be rotated with respect to the hub section of the handle member to allow angular adjustment thereof, and a spring member between the hub section of the handle member and the comb hub of the first lower comb member for selectively retaining the detents thereof in locked engagement, a second upper comb member including a comb arm and a comb hub, the comb hub of the second upper comb member being rotatably mounted on and with respect to the hub section of the handle member, the second upper comb member having a comb attached to the comb arm thereof, and further including a lever member for allowing the second upper comb member to be depressed by a thumb and rotated with respect to the handle member and also with respect to the first lower comb member to enable a length of hair engaged by the comb to be raised for cutting, the detents of the handle member and the first lower comb member comprise meshing teeth on the respective hub section and comb hub, and a spring member is disposed between the hub section of the handle member and the hub of the second comb member for normally biasing the second upper comb member in a predetermined direction.

19. A haircutting device for aiding in cutting selected lengths of hair comprising a handle member having a hand grip section and a hub section, said handle member having detents thereon, a first lower comb member including a comb arm and a comb hub, the comb hub being pivotally mounted with respect to the hub section of the handle member, and including detents for cooperating with the detents of the handle member to enable the first comb member to be rotated and selectively locked in a predetermined angular relationship with respect to the handle member, the comb hub of the first lower comb member being axially movable with respect to the hub section of the handle member to disengage the respective detents thereof and to allow the comb hub to be rotated with respect to the hub section of the handle member to allow angular adjustment thereof, and a spring member between the hub section of the handle member and the comb hub of the first lower comb member for selectively retaining the detents thereof in locked engagement, a second upper comb member including a comb arm and a comb hub, the comb hub of the second upper comb member being rotatably mounted on and with respect to the hub section of the handle member, the second upper comb member having a comb attached to the comb arm thereof and further including a lever member for allowing the second upper comb member to be depressed by a thumb and rotated with respect to the handle member and also with respect to the first lower comb member to enable a length of hair engaged by the comb to be raised for cutting, the comb of said second upper comb member has a base section detachable from the comb arm of the second upper comb member, and has a plurality of teeth for enabling a length of hair to be lifted for cutting, and the teeth of the comb of said upper comb member include a plurality of primary teeth having tips with rounded edges and including a plurality of shorter and finer teeth intermediate said primary teeth to facilitate obtaining a firm hold on the hair as the comb of the second comb member lifts hair to be cut.

20. A haircutting device as in claim 19 wherein each of the respective handle member, first lower comb member and second upper comb member is integrally molded as one piece.

21. A haircutting device for aiding in cutting selected lengths of hair comprising a handle member having a hand grip section and a hub section, said handle member having detents thereon, a first comb member including a comb arm and a comb hub, the comb hub being pivotally mounted with respect to the hub of the handle member, and including detents for cooperating with the detents of the handle member to enable the first comb member to be rotated and selectively locked in a predetermined angular relationship with respect to the handle member, a second comb member including a comb arm and a comb hub, the comb hub of the second comb member being rotatably mounted on and with respect to the handle member, the second comb member having a comb attached to the comb arm thereof, and further including a lever member for allowing the second comb member to be rotated with respect to the handle member and also with respect to the first comb member to enable a length of hair engaged by the comb to be raised for cutting, the comb of said second comb member has a base section detachable from the comb arm of the second comb member and has a plurality of teeth for enabling a length of hair to be lifted for cutting, and the teeth of the second comb include a plurality of primary teeth having tips with rounded edges and including a plurality of shorter and finer teeth intermediate said primary teeth to facilitate obtaining a firm hold on the hair as the comb of the second comb member lifts hair to be cut.

* * * * *